US006988441B2

(12) United States Patent
Harcourt et al.

(10) Patent No.: US 6,988,441 B2
(45) **Date of Patent: *Jan. 24, 2006**

(54) ROTARY ENGINE

(75) Inventors: Dougal Lamont Harcourt, Queensland (AU); Robert James Selby, Christchurch (NZ); William Lewis White, Christchurch (NZ)

(73) Assignee: Harcourt Engine Pty Limited, Mooloolaba (AU)

( * ) Notice: Subject to any disclaimer, the term of this patent is extended or adjusted under 35 U.S.C. 154(b) by 0 days.

This patent is subject to a terminal disclaimer.

(21) Appl. No.: 10/790,141

(22) Filed: Mar. 2, 2004

(65) Prior Publication Data

US 2004/0163532 A1 Aug. 26, 2004

Related U.S. Application Data

(63) Continuation of application No. 10/148,189, filed as application No. PCT/NZ00/00241 on Dec. 7, 2000, now Pat. No. 6,705,202.

(30) Foreign Application Priority Data

Dec. 7, 1999 (NZ) ..... 501608

(51) Int. Cl.
*F01B 13/04* (2006.01)

(52) U.S. Cl. ..... 92/56; 123/43 C

(58) Field of Classification Search ..... 92/54, 92/56; 123/43 C, 43 R
See application file for complete search history.

(56) References Cited

U.S. PATENT DOCUMENTS

| | | | | |
|---|---|---|---|---|
| 1,285,835 | A | 11/1918 | Sunderman | |
| 1,766,385 | A | 6/1930 | Jackson | |
| 1,918,174 | A | 7/1933 | Berggren | |
| 1,943,937 | A | 1/1934 | Gustafson | 123/43 |
| 1,965,548 | A | 7/1934 | Hart | 123/70 |
| 2,417,894 | A * | 3/1947 | Wayland | 123/43 C |
| 3,438,358 | A | 4/1969 | Porsch et al. | 123/17 |
| 3,939,808 | A | 2/1976 | Kostecki et al. | 123/43 |
| 4,106,443 | A | 8/1978 | Triulzi | 123/43 |
| 6,705,202 | B2 * | 3/2004 | Harcourt et al. | 92/56 |

FOREIGN PATENT DOCUMENTS

| | | |
|---|---|---|
| AT | 8496 | 7/1927 |
| AU | 110318 | 4/1940 |
| EP | 964136 A1 | 12/1999 |
| FR | 588.204 | 7/1924 |
| FR | 46.062 | 2/1935 |
| FR | 54.015 | 5/1945 |
| WO | WO83/01091 | 3/1983 |

* cited by examiner

*Primary Examiner*—Thomas E. Lazo
(74) *Attorney, Agent, or Firm*—Jacobson Holman PLLC

(57) ABSTRACT

An engine includes a rotatable member with one or more cylinders disposed tangentially around its circumference. There are one or more corresponding pistons, each piston is associated with a piston lever pivoted eccentric to the rotatable member. Movement of each piston is controlled so that combustion energy is transmitted to the rotatable member by the cylinder moving away from the piston. Both the cylinders and pistons rotate continuously relative to a stationary part of the engine.

20 Claims, 7 Drawing Sheets

ROTARY ENGINE

This is a Continuation of application Ser. No. 10/148,189 filed Oct. 3, 2002, now U.S. Pat. No. 6,705,202 issued Mar. 16, 2004 which is a 371 of application Ser. No. PCT/NZ00/00241, filed Dec. 7, 2000.

FIELD OF THE INVENTION

The invention relates to engines. In particular it relates to engines that may be used either as a power source or as a pump.

BACKGROUND TO THE INVENTION

It is a recognised fact that most piston engines are inherently inefficient. A number of factors add to this inefficiency including the motion of the pistons, and the fact that to a large extent the piston is either at rest or in a drag state which reduces the effect of the energy available at the engine's crank. Also, a significant amount of energy is required to move the piston to the top of the bore during the compression or pump stroke.

A further cause of inefficiency, in for example existing internal combustion engines, is that there are gears, cams and other equipment necessary to enable the engine to function. This results in reduced efficiency, and in the final analysis only a small percentage of input energy is transferred to the output.

Rotary type engines overcome some of the above problems. However, such engines are complex and there are sealing problems between the moving parts. While they have dramatically changed the design of standard piston and cylinder engines they have resulted in complex sealing and design problems which result in unreliability.

Hybrid type engines are known. One such hybrid, described in EPO964136, is a rotary type configuration with the engine block defining a cylindrical rotor having a plurality of bores which open to combustion chambers near its periphery. A piston is disposed in each bore. Each piston has its own crank with rotation being transferred to the engine block/rotor via a planetary gearbox arrangement. Inlet ports, spark plugs and outlet ports are arranged around the periphery of the engine housing in the same manner as a conventional rotary engine. The claimed advantage of this configuration is that the power/movement of the pistons is almost completely converted to rotational movement of the engine and thus it produces a greater power output per size/weight than a conventional piston engine. A further claimed advantage is that the rotary nature of the engine does away with the need to employ valves and thus the associated problem of valve damage in conventional engines. However, the engine still suffers from considerable sealing problems and losses in the planetary gearbox linking the piston rods to the rotor.

Another hybrid type engine is described in AU 8496/27. This engine is of the type that has a continuously rotating group of cylinders disposed tangentially on a main rotatable member. Corresponding pistons are intermittently rotating. The pistons are attached to piston levers pivoted about the centre of rotation. In order to achieve correct operation of this engine the pistons must be locked against movement in either direction during combustion so that energy can be transferred to the rotatable member via the cylinders. After combustion the piston must accelerate at twice the speed of the rotary member in order to move back to top dead centre for the next combustion stroke. A sophisticated arrangement of gears and levers are required to operate the piston in this manner manner. Because the piston must travel at twice rotational speed the engine's maximum speed is limited by the ability to move the piston from standstill to top dead centre.

As well as the above mentioned disadvantages, in existing piston engines the time the piston spends at the top and bottom of the stroke is very short as the cranksharft operates to change direction at the instant that the extreme of piston travel is reached. This reduces dwell and leads to incomplete burning of gases in combustion. These incompletely burnt gases are expelled in the exhaust resulting in inefficiencies in the engine and pollution of the atmosphere.

Accordingly it is an object of the present invention to provide an engine which is efficient and economical to run. It is a further object of the present invention to provide an engine which has high rotational inertia and torque relative to its size and weight.

It is still a further object of the present invention to provide an engine which may be controlled in a variety of ways to meet a variety of functional needs. Yet a further object of the present invention to provide an engine which ameliorates some of the disadvantages of known engines, or at least provides the public with a useful choice.

SUMMARY OF THE INVENTION

In a first aspect the invention provides for an engine including one or more cylinder and piston groups disposed in or on a rotating member, the longitudinal axis of the one or more cylinder and piston groups being orientated tangential to the rim of the rotating member, and wherein both the cylinders and pistons rotate continuously relative to a stationary part of the engine.

In a second aspect the invention provides for an engine including:

a rotatable member;

one or more cylinders disposed around the circumference of the rotatable member, the longitudinal axis of the cylinders being tangential to the circumference of the rotatable member; and one or more pistons, each piston associated with a corresponding cylinder, the engine characterised in that each piston is associated with a piston lever pivoted eccentric to the rotatable member and wherein movement of each piston is controlled such that combustion energy is transmitted to the rotatable member by the cylinder moving away from the piston.

Preferably movement of each piston is controlled independently of rotation of the rotatable member.

Preferably the piston is engaged, either directly or via a connection rod, to the distal end of the piston lever, the proximal end of the piston lever being manipulated to control movement of the piston relative to the cylinder.

Preferably one or more piston controllers are disposed adjacent the proximal end of the piston lever, the proximal end of the piston lever being adapted to movably engage a surface or edge of the piston controller and communicate movement to the piston lever.

Preferably only one piston controller is disposed concentric to the rotatable member, the piston controller being a cylindrically shaped disk having one or more lobes on its circumferential surface.

Preferably the piston controller is rotationally independent of the rotatable member.

Preferably the piston controller is rotated in the opposite direction to the rotatable member.

Preferably the piston controller is utilised to control the time that the pistons spend at the either end of their stroke.

Preferably an energy stroke delivered to the rotatable member is longer than a combustion stroke of the piston.

Preferably a compression stroke assists in supplying rotational energy to the rotatable member.

Preferably the proximal ends of piston lever from two or more diametrically opposed pistons are joined or linked so that excursion of a piston on an compression stroke assists the excursion of a diametrically opposed piston on a compression stroke.

Preferably one or more weights are associated with the one or more piston levers, centrifugal force acting on the weights to aid excursion of the pistons within the cylinders.

Preferably substantially all of the force exerted in movement between the cylinders and pistons is along the longitudinal axis of the cylinders thereby reducing the effect of cylinder bore side thrust.

Preferably the force generated at the cylinders is delivered directly to an output shaft without the intervention of any other mechanical parts.

Further aspects of the invention will become apparent from the following description, which is given by way of example only.

BRIEF DESCRIPTION OF THE DRAWINGS

The invention will now be described with reference to the accompanying drawings in which.

DESCRIPTION OF THE EMBODIMENTS

Figure 1:
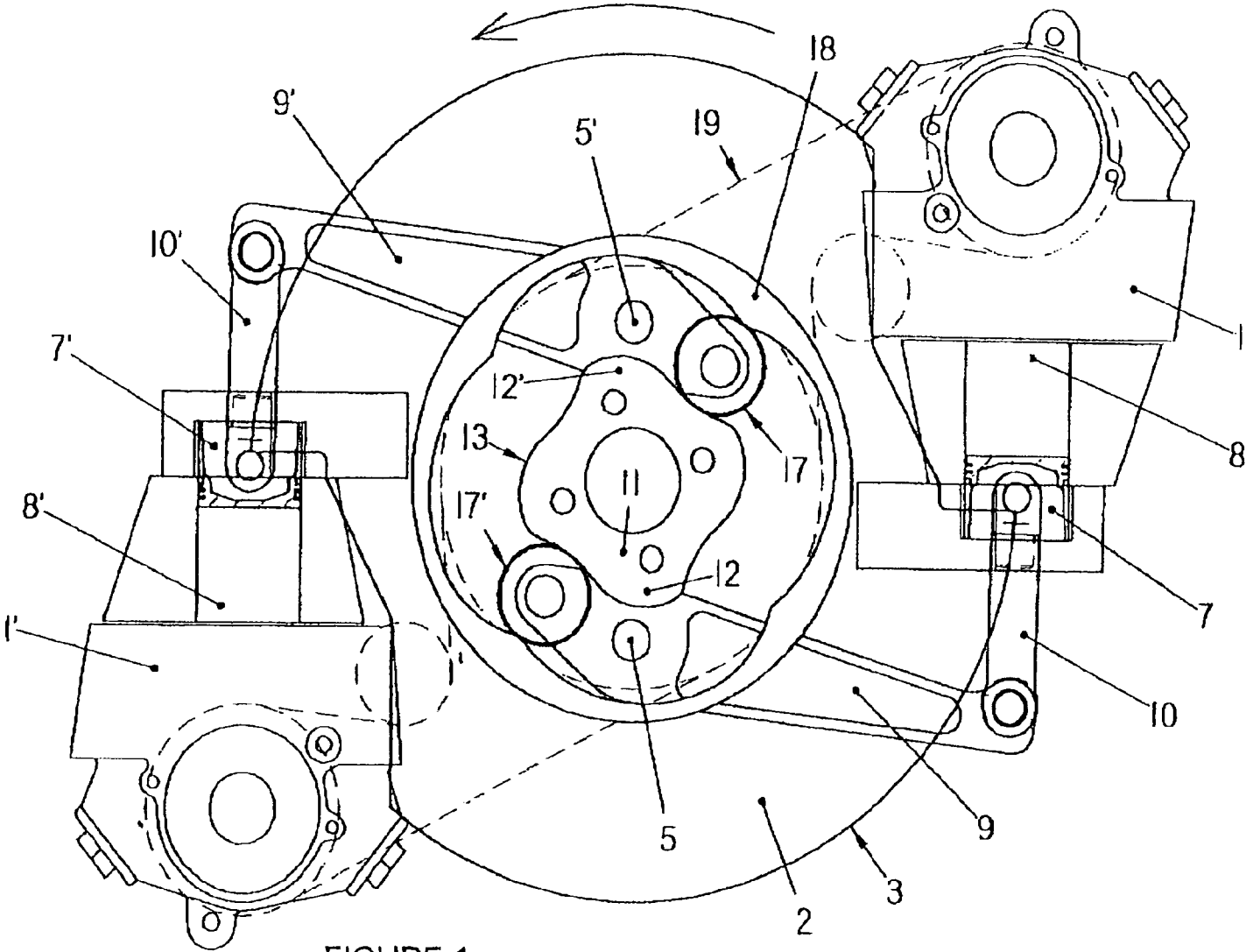
FIG. 1 illustrates a first four stroke embodiment of an engine according to the invention.

The invention will now be described with reference to its use as an internal combustion engine. Use of the engine as a pump is not excluded and such use is within the ability to be attributed to the skilled addressee.

Referring now to the drawings, wherein like features are designated by like reference numerals, preferred embodiments of an engine according to the invention are shown. The principle will be discussed with reference to the embodiment illustrated in FIG. 1. The cylinders 1 are mounted on a main rotatable member, or rotor, 2 with their longitudinal axis tangential to rotor rim 3. Each cylinder 1 has an associated piston lever 9 and piston 7 which engages a bore 8 in known manner. Standard piston and cylinder assemblies may be utilised. The engine operates opposite to conventional combustion engines in that during combustion movement of the piston 7 is controlled causing the cylinder 1, which is disposed on rotor 2, to move. This results in rotation of rotor 2 and output shaft 8. For the arrangement illustrated the direction of rotation is shown by arrow A.

Piston lever 9 is pivotably engaged with rotor 2 at a fulcrum point 5 which is eccentric with rotor 2. In the centre of, and concentric with, rotor 2 is a piston controller 11. Piston controller 11 is cylindrically shaped with a plurality of lobes 12 around its circumferential surface 13. In the most simple embodiment of the engine piston controller 11 is rotationally stationary so that rotor 2, piston levers 9, and hence pistons 7 rotate about it.

At the proximal end 15 of each piston lever 9 is a roller 17 which engages the circumferential surface 13 of piston controller 11. As cylinder 1 and rotor 2 rotate piston lever 9 also rotates due to its fulcrum point 5 being eccentrically disposed. Roller 17 follows circumferential surface 13 communicating motion to piston lever 9. The fulcrum 5 of piston lever 9 is closer to proximal end 15 of lever 9 than distal end 16 of lever 9 and thus a small amount of movement at proximal end 15 is translated into substantial movement at distal end 16.

A piston connector rod 10 is pivotably engaged between distal end 16 of piston lever 9 and piston 7. As roller 17 follows the circumferential surface 13 of piston controller 11 piston 7 is moved within the bore 8. As roller 17 moves onto lobe 12 the piston 7 is moved to top dead center of bore 8. If fuel has been introduced and the spark plug (not shown) is fired combustion of the compressed fuel vapour will occur. In a conventional engine expansion of the combustion gases would drive piston 7 back down bore 8 causing rotation of a crankshaft. However, in the engine of the current invention piston 7 cannot move backwards as its movement is controlled by piston lever 9 and piston controller 11. As a result, when combustion occurs cylinder 1 moves away from piston 7 delivering rotational energy to rotor 2 in the direction of arrow A.

Because piston 7 is pivotably disposed on rotor 2, via piston lever 9, it continuously rotates with rotor 2. However, its speed/motion, and hence position, relative to cylinder 1 can be controlled by shaping of lobes 12 on piston controller 11 and thus the time taken for piston 7 to go from top-dead-centre to bottom-dead-centre within cylinder 1 can be lengthened to extend the effective energy stroke experienced by rotor 2.

While the illustrated embodiments utilise a piston controller 11 disposed concentric with rotor 2 it is possible that an embodiment of the engine may utilise two or more piston controllers disposed adjacent proximal end 15 of piston lever 9. The two or more piston controllers could be linked and timed by gears or a timing belt and communicate motion individually to their adjacent piston lever 9. This arrangement would be suitable for an engine with a large diameter rotor and would enable shorter piston levers to be utilised. While such an embodiment is possible it is not preferred as it introduces additional gears and timing mechanisms and thus reduces the simplicity of the engine.

In some operating circumstances roller 17 will not follow surface 13 of the piston controller 11. To hold roller 17 against piston controller 11 an outer journal or collar 18 is provide with a machined inner surface which parallels the profile of the controller surface 13. In the alternative embodiments shown in FIGS. 2 and 3 collar 18 is omitted. Roller 17 is forced to follow surface 13 by a spring 14 which is positioned to apply force to piston lever 9 at a point 20 part way between distal end 16 and fulcrum 5. In both FIGS. 2 and 3 end 21 of spring 14 is located in a spring retainer 22 clamping the spring in position.

Figure 2:
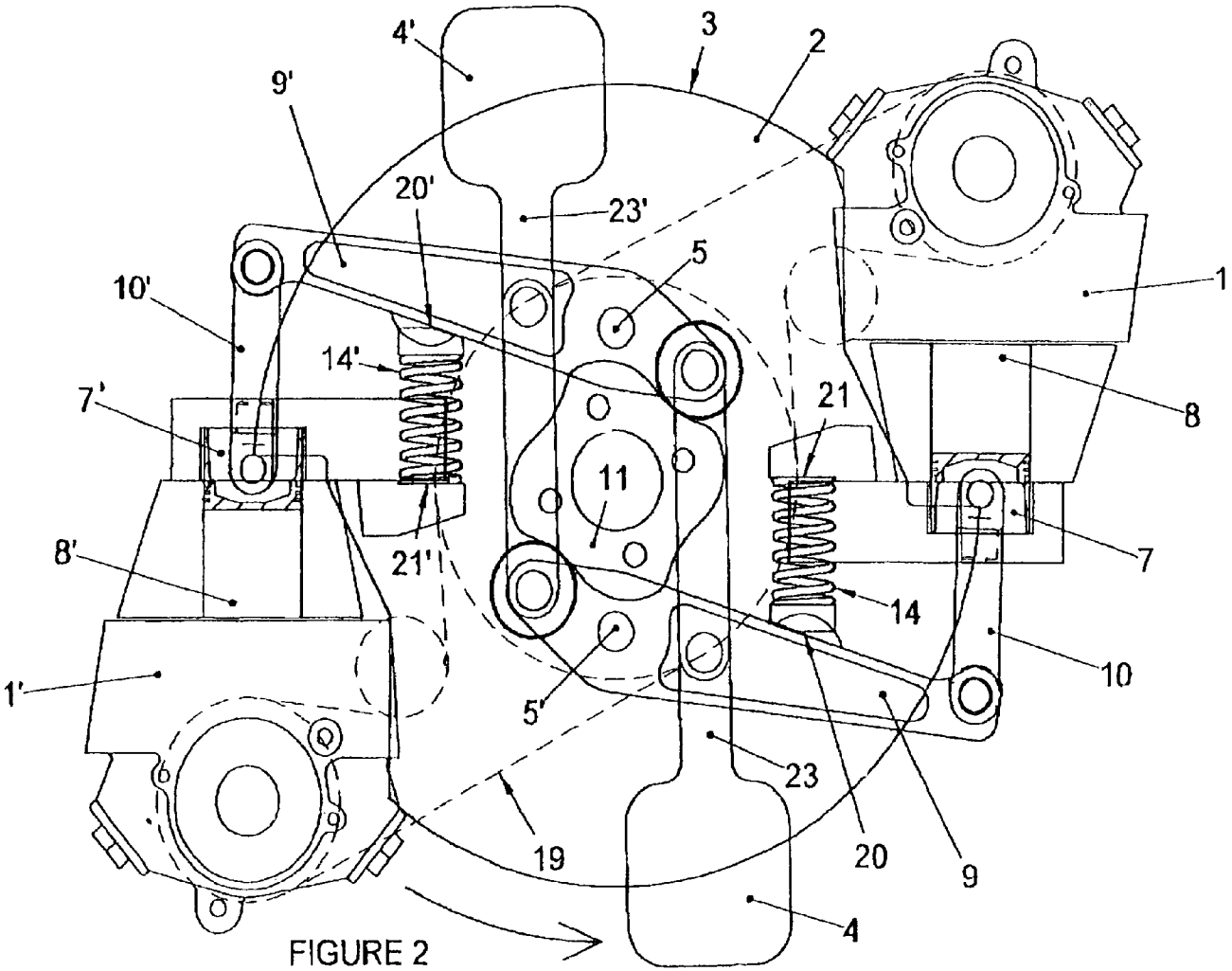
FIG. 2 illustrates a second four stroke embodiment of an engine according to the invention.
Figure 3:
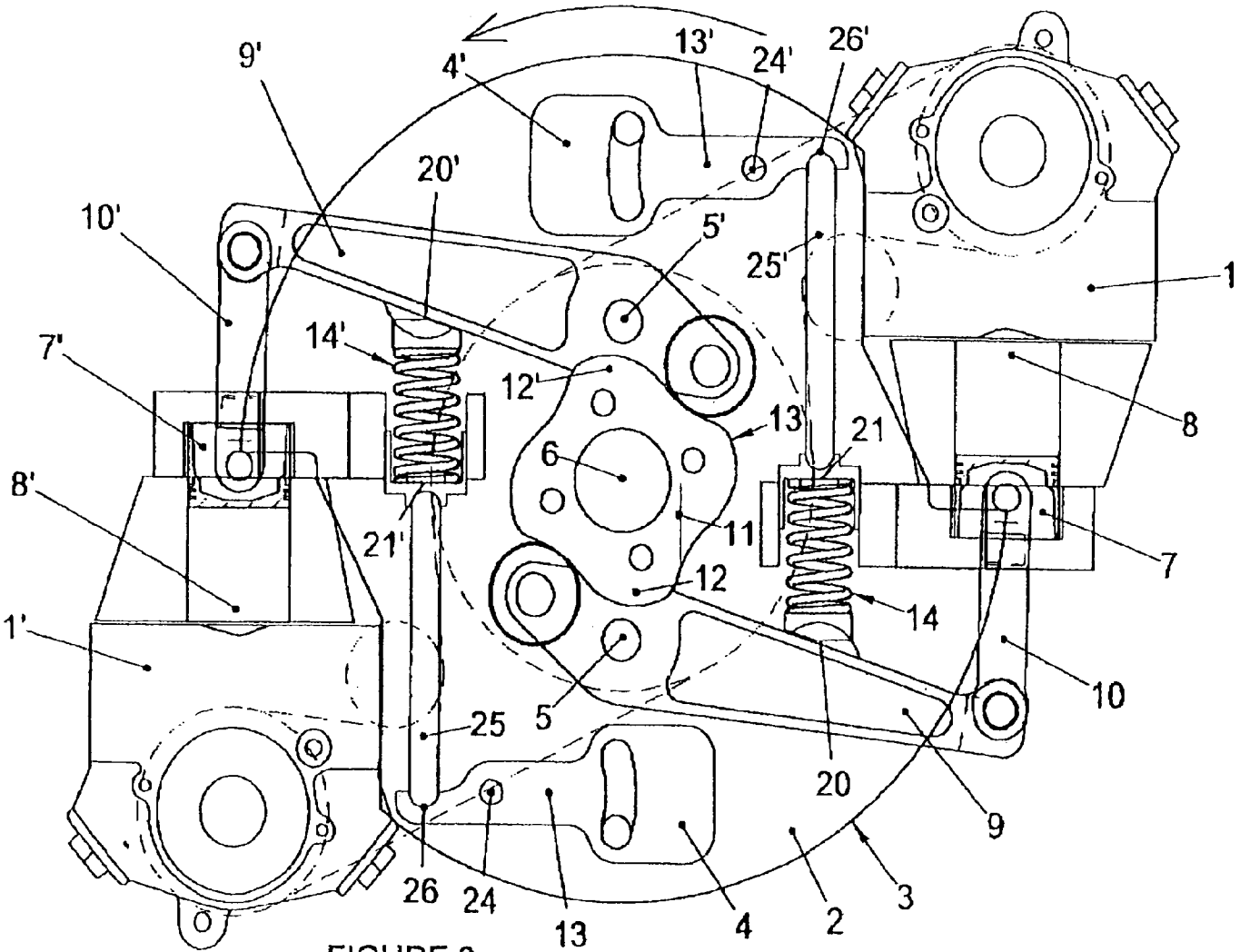
FIG. 3 illustrates a third four stroke embodiment of an engine according to the invention.

The fundamental principle of operation of the four stroke engine shown in FIGS. 2 and 3 is the same as that in FIG. 1. However, the embodiments in FIGS. 2 and 3 introduce the concept of utilising centrifugal force to aid control of the piston. Referring to FIG. 2, a weight 4 is secured to proximal end 15 of piston lever 9 by an arm 23. The arrangement is such that during rotation of the engine centrifugal force acting on weight 4 causes a radially acting force that assists in holding roller 17 against surface 13 of the piston controller.

The use of centrifugal force in the embodiment illustrated in FIG. 3 is different in its arrangement but has the same effect in principle as that of FIG. 2. In this embodiment arm 23 is pivotably engaged with rotor 2 at a fulcrum point 24. At distal end 26 of lever 23 is a further lever 25 which engages pivoting lever 23 with end 21 of spring 14. As the engine is rotated centrifugal forces move arm 4 radially outwards and spring 14 is compressed or preloaded to apply more force to piston lever 9.

The effect of the arrangement in both FIGS. 2 and 3 is to make the effort applied in controlling piston lever 9, and hence piston excursions, relative to rotational speed of the engine. This means that at low speeds less energy is lost to the mechanics of working the equipment necessary to enable the engine to function and at high speeds, when greater control effort is needed the energy for such is extracted from centrifugal force inherent in the rotating engine. Further aspects of the use of centrifugal force are described later in the description.

It will be apparent to the skilled addressee that an engine according to the invention could operate as either a two or four stroke engine. FIG. 1 illustrates a four stroke engine. The four piston strokes are suction, compression, combustion (or expansion) and exhaust strokes. It will be appreciated by the skilled addressee that in the embodiment shown in FIG. 1 rollers 17 and 17' ride up onto lobes 12 and 12' simultaneously forcing both pistons 7 and 7' to top dead centre at the same time. A timing belt (shown by dashed line 19) controls operation of the cylinder head valves (not shown). The typical arrangement could be such that when piston 7 was on a compression stroke diametrically opposite piston 7' would be on an exhaust stroke.

It will also be apparent to the skilled addressee that any number of cylinders may be disposed around rim 3 of rotor 2 and that by appropriate timing of valves, ignition spark and positioning of lobes 12 on piston controller 11 a variety of firing sequences may be achieved. Timing for the ignition spark may be via a mechanical-type distributor directly driven from the axis of rotor 2 or via a gear on timing belt 19. Alternatively, an electronic-type distributor may utilise a transducer adapted to detect the angular position of rotor 2 or piston controller 11.

In practice the number of cylinders that may be disposed around a single rotor 2 is limited by physical size and complexity in overlapping piston levers for engagement with the piston controller. In a more practical arrangement one or more rotors carrying two cylinders each may be disposed along a common output shaft to produce a 2, 4, 6 etc cylinder engine as desired. It should also be appreciated that the engine could have only one cylinder. In a single cylinder embodiment rotor 2 must be counterbalanced by weight opposite the cylinder, piston and lever.

Figure 4:
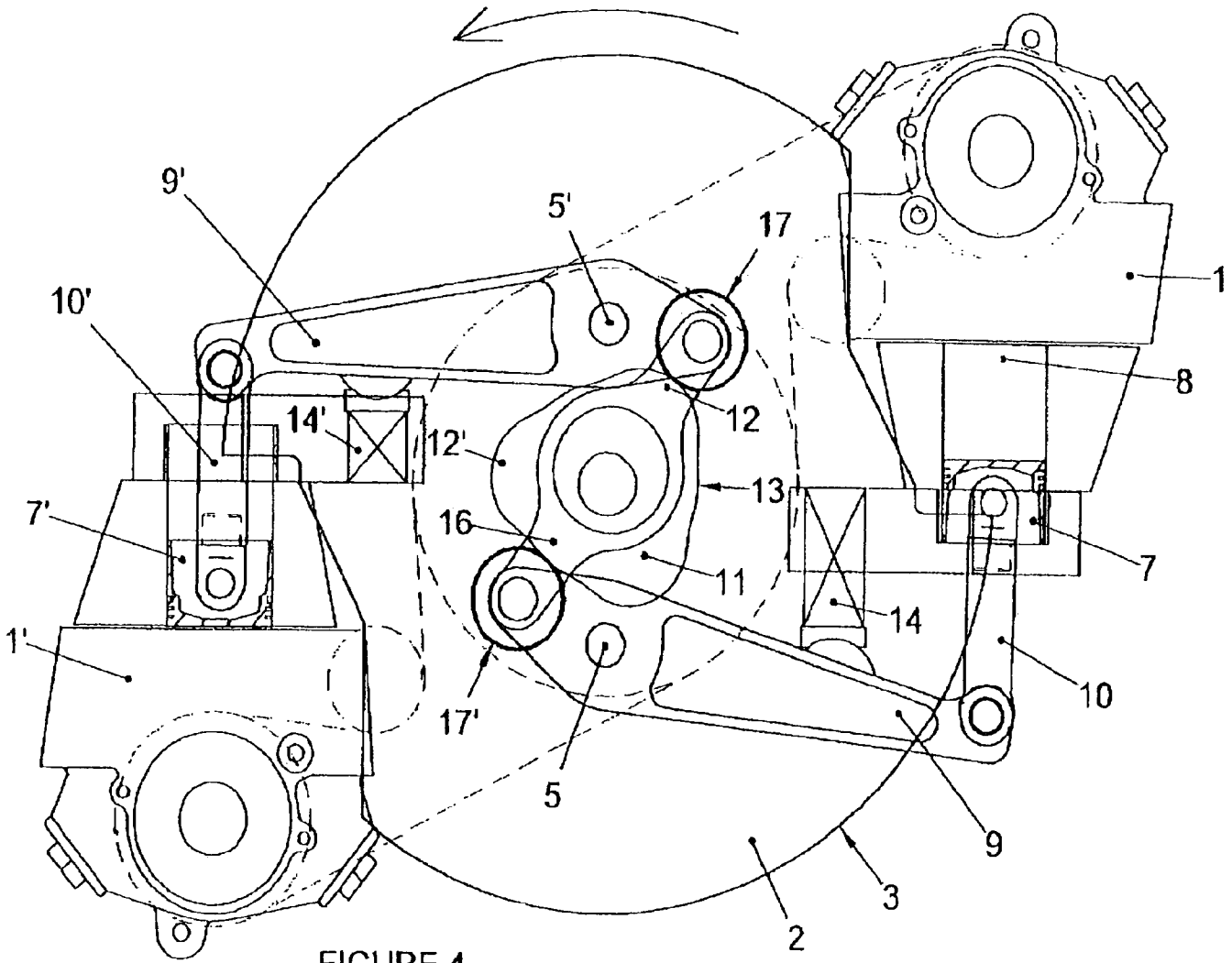
FIG. 4 illustrates a fourth four stroke embodiment of an engine according to the invention.

FIG. 4 illustrates an embodiment of a four stroke engine which has 6 strokes, or 1.5 ignition cycles, per revolution. This engine differs from previous embodiments in that pistons 7 and 7' are travelling in different directions. For example, when piston 7 is travelling down the bore 8 on, say, the expansion stroke piston 7' is travelling up the bore 8 on the compression stroke. Springs 14 keep rollers 17 against piston controller surface 13. An arm 16 is also provided which links proximal ends 15 and 15' of the piston levers.

Figure 5:
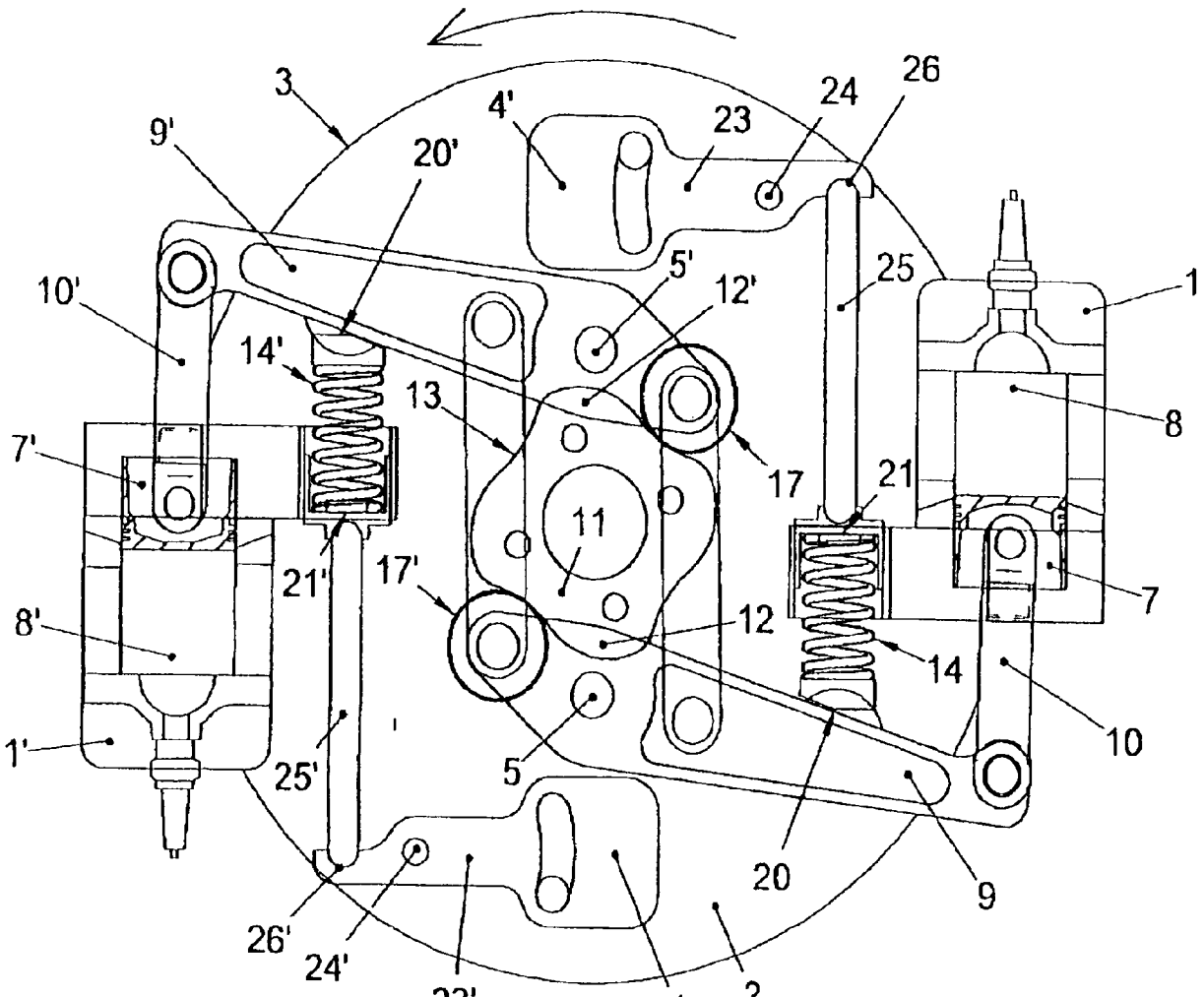
FIG. 5 illustrates a two stroke embodiment of an engine according to the invention.

Referring to FIG. 5: shown is a two stroke embodiment of an engine according to the invention. Combustion occurs each time pistons 7 reach at or near top dead centre of cylinder 1. The arrangement shown in FIG. 5 is such that both pistons are simultaneously on compression strokes and expansion strokes. However, by arrangement of lobes 12 on piston controller 11 the engine could be arranged to have one cylinder on compression stroke while the other was on expansion stroke. Further, any number of cylinders may be arranged around rotor 2.

A significant advantage of an engine according to the current invention is that it allows for the number of combustion strokes per revolution to be dynamically varied. Piston controller 11 can be easily made rotationally and/or directionally independent of rotor 2. By dynamically varying the rotational speed and/or directional of piston controller 11, along with valve and ignition timing, relative to rotor 2 the number of strokes per revolution are varied. For example, in the four stroke embodiment of FIG. 1 the stationary piston controller results in each piston doing 8 strokes or two ignition cycles per revolution. However, if the rotational speed or direction of the rotor is r: rotating the piston controller at r results in zero ignition cycles per revolution (i.e. freewheeling); rotating the piston controller at 0.5r results in one ignition cycle per revolution; and rotating the piston controller at -r (i.e. in the opposite direction to rotor 2 making a relative difference of 2r) results in 4 ignition cycles per revolution. The result of such an arrangement is that a constant revolution variable power engine can be produced. This has application in for example AC electrical generators where rotational speed must be kept constant to control supply frequency, and power varies with supply load.

An additional advantage of an engine according to the present invention is that it allows for total control over dwell of the piston at any position in the stroke. This is achieved by shaping of the piston controller lobes 12. This cannot be achieved in conventional reciprocating piston engines as piston movement is controlled by the crankshaft and other pistons. By achieving better control of timing and dwell through the utilisation of piston controller 11 a greater level of fuel burn can be achieved thereby improving efficiency and emissions.

A further advantage of an engine according to the invention is that energy is directed to rotor 2 during both combustion and compression strokes. The energy applied during the combustion stroke has previously been described. During the compression stroke piston 7 is moving from bottom dead centre to top dead centre within bore 8. As compression of gasses occur force is exerted on the top of the bore. This energy is in the direction of rotation and adds to the rotational energy of the engine.

A still further advantage of an engine according to the invention is that because movement of the piston within the bore is at all times longitudinal to the axis of the cylinder, cylinder bore side thrust is reduced. This reduces both ware on the cylinder bore and the force required to move the piston within the bore. In conventional piston engines cylinder bore side thrust, which is caused by rotational movement of the crankshaft pushing the piston against one side of the bore on the up-stroke and against the opposite side wall of the bore on the down-stroke, is a significant problem. Further mechanical losses are also reduced because combustion energy is transmitted directly to the rotational member, and thus the output shaft, rather than through other moving mechanical parts such as connector rods.

Figure 6:
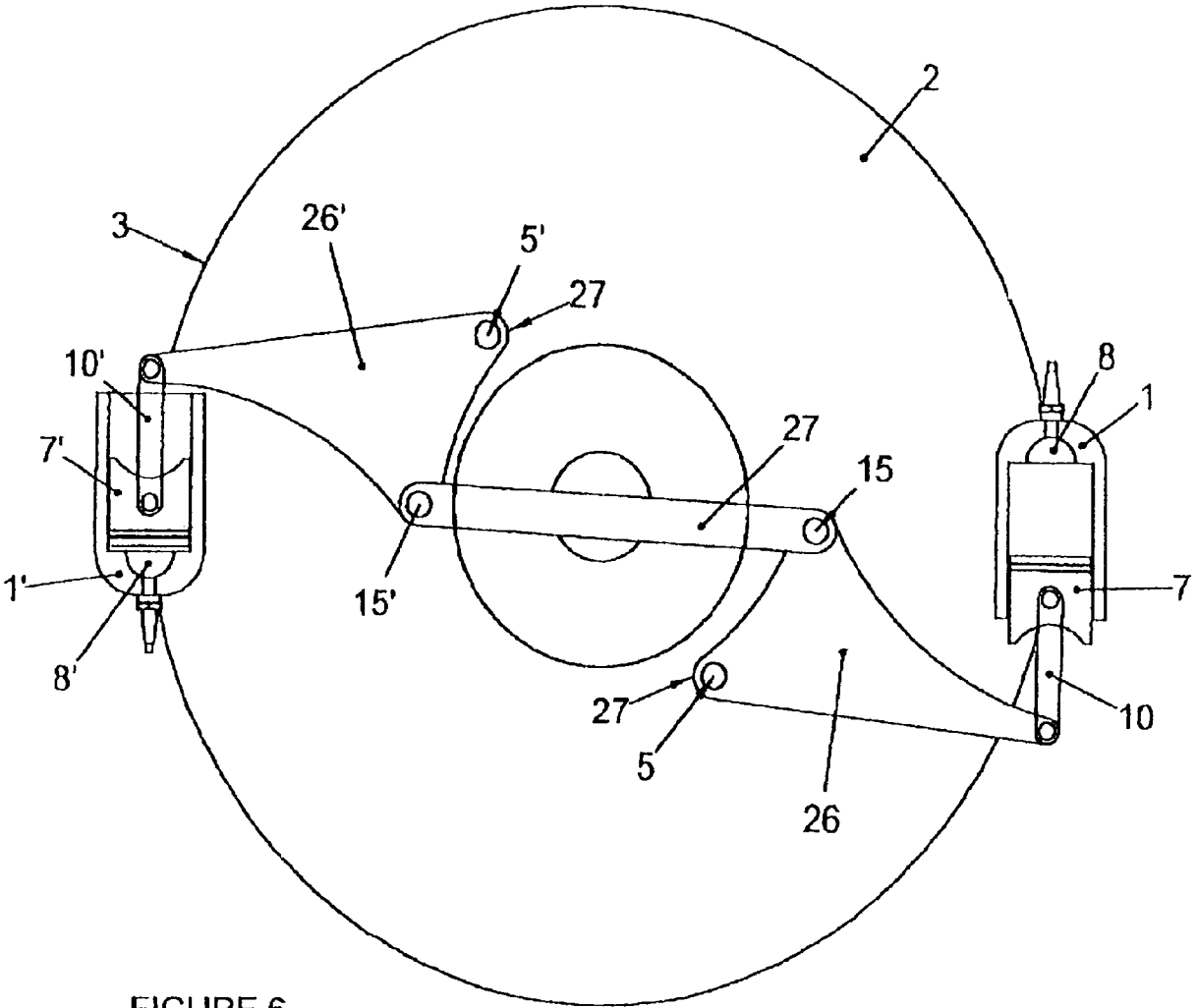
FIG. 6 illustrates a two stroke reciprocating embodiment of an engine according to the invention.

Referring to FIG. 6, a two stroke reciprocating embodiment of an engine according to the invention is shown. This engine takes significant advantage of the above mentioned principle. In this embodiment a substantially L shaped piston lever 26 is utilised. The pivoting fulcrum point 5 for L shaped piston lever 26 is at its elbow 27. At proximal end 15 of L shaped piston lever 26 is a pivotably engaged lever 27 which links L shaped piston lever 26 to proximal end 15' of corresponding piston lever 26' from a diametrically opposed cylinder/piston group. Because of the reduced timing requirements for the two stroke embodiment piston controller 11 is omitted. During the combustion stroke some relative backwards movement of piston 7 is possible. Energy from this backwards movement is transferred via the lever arrangement (piston lever 26-link 27-piston lever 26') to the compression stroke of the diametrically opposed piston 7'. The arrangement is such that by the above mentioned principle energy is transferred to the rotor 2 on the compression stroke of piston 7'.

Figure 7:
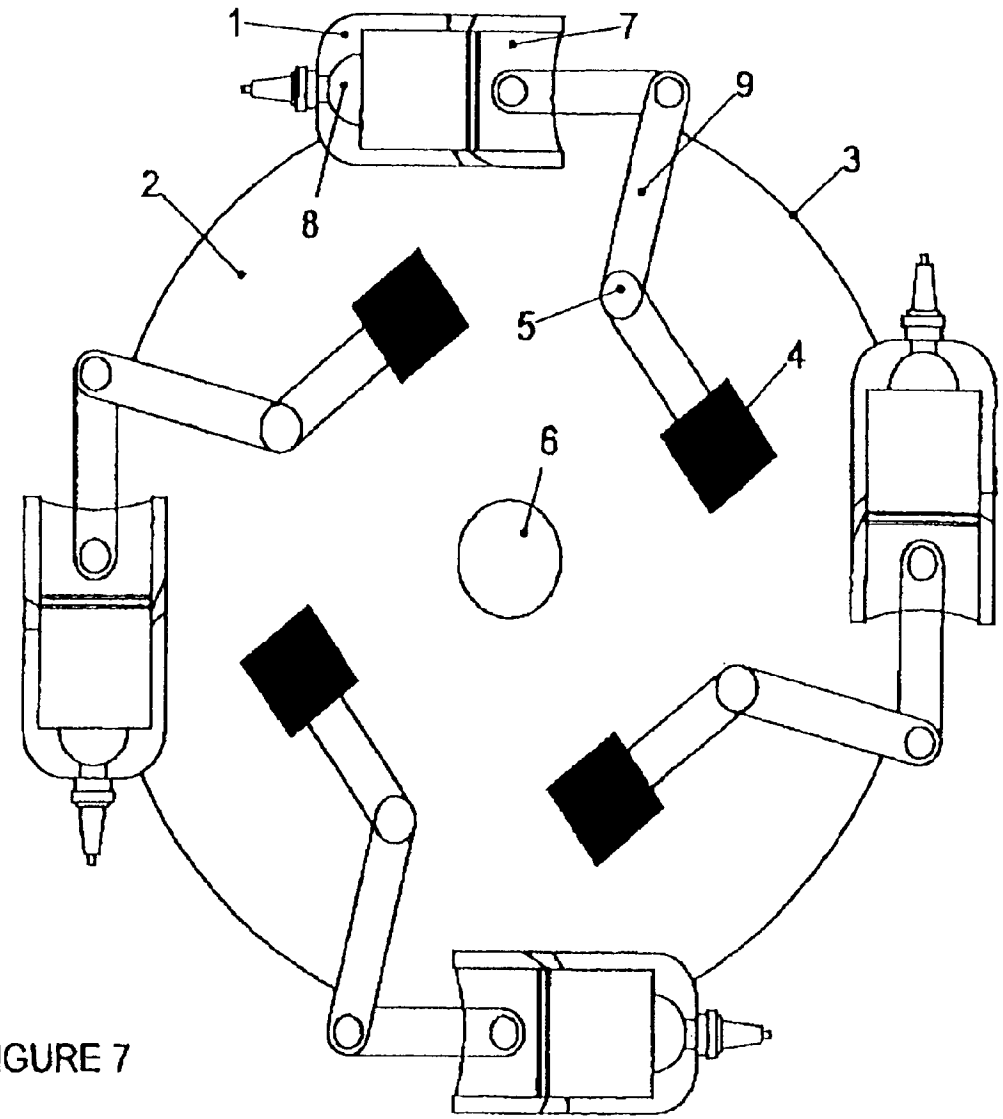
FIG. 7 illustrates a schematic representation of a centrifugal force assisted engine according to an aspect of the invention.

FIG. 7 illustrates, in schematic, how centrifugal force can used to control movement of the piston 7. This is achieved by a weight 4 and a simple linkage 9 that operates about a pivot 5. The force produced by centrifugal force acting on weight 4 is used to maximise the ignition energy direct to the rim 3 of the flywheel 2 and hence the output shaft 6. Maximum torque occurs when the explosive energy is directed to the flywheel rim 3 as this is the point of greatest leverage on the output shaft 6.

Centrifugal force is inherent in most engines and more particularly the flywheel 2. The applicant believes it is the first time ever that centrifugal force has been used to control the pistons 7 through a simple pivot linkage system 9. It drives the piston 7 up the cylinder 1 into the bore 8. When fuel is introduced combustion occurs. Combustion tries to drive the piston 7 back a long the cylinder, however centrifugal force acting through the weight 4 and linkage 9 slows the action down. The result is that mass (flywheel 2) to which the cylinder 1 is attached, moves away from the piston 7, thus supplying energy to the flywheel 2 which moves around its axis or shaft 6 outlet. The flywheel 2 with its inertia and leverage supplies high torque energy output to the shaft 6. Inertia delivers a high smooth torque source to the shaft outlet.

When the end of the piston 7 travel has been reached after combustion, normal exhausting takes place. This is helped by a venturi vacuum effect, occurring as a result of the motion of the flywheel 2 and its capacity to create a wind venturi vacuum effect.

Centrifugal force also assists in the cleansing of the piston chamber.

Also, on the opposite side of the bore 8, the inlet may be designed to have a ram effect, scooping up a fresh charge of air as the cylinder housing revolves around the fly wheel 2, which is itself due to the wind force.

When exhausting takes place, the explosive energy is exhausted but centrifugal force remains constant. Centrifugal force drives the piston 7 back along the bore 8 starting the cycle all over again.

With centrifugal force providing the energy for combustion almost all of the combustible explosive energy is directed to the rim 3 of the flywheel 2 with minimum losses. Centrifugal force also plays a major role in providing energy to the flywheel engine. As the piston 7 is being driven along the cylinder, it produces drag (which can be increased through a mechanical device) and this provides further rotational energy. As the piston 7 is forced up to the cylinder 1, compression against the bore 8 adds a significant amount of additional energy to the rotating flywheel 2.

The use of constant centrifugal force to drive the piston 7 through to compression stroke, and the additional energy given to the flywheel 2 through drag and compression, have not been attempted or achieved in any other engine known to the applicant. Neither has movement of the cylinder 1 away from the piston 7, due to the control of the pivot linkage system 9 through centrifugal force.

The centrifugal forces associated with that much torque and horsepower are going to make the braking of its momentum very difficult, when attempting gear changes etc. The solution is to design and perfect a hydraulic pump system, where all the drive wheels are driven from a central pressure point and the engine provides a very strong pump for the hydraulic drive system, or electricity production with electric motors in the drive wheels. This would allow a variation of driving forces without having to stop the massive momentum of this engine every time you wanted to change gears.

Where in the description particular mechanical integers are described it is envisaged that their alternatives can be substituted as if they were individually set forth herein.

Particular examples of the invention have been described and it is envisaged that improvements end modifications can take place without departing from the scope thereof.

What is claimed is:

1. A rotary engine including:

a rotatable member;

two or more cylinders spaced circumferentially of said rotatable member, respective longitudinal axes of said two or more cylinders being located adjacent an outer region of said rotatable member and extending tangentially to a rotational path thereof; and, two or more pistons, each piston being associated with a respective cylinder, each said piston being associated with a respective piston lever pivoted on said rotatable member at a fulcrum point eccentrically to a rotational axis of said rotatable member and wherein movement of each said piston between top and bottom dead centres is controlled such that combustion energy is transmitted to said rotatable member by said two or more cylinders moving away from said respective two or more pistons, said engine characterized in that movement of each said piston is controlled by a piston controller disposed adjacent a proximal end of a respective piston lever, the proximal end of each said piston lever being coupled with said piston controller to communicate movement to a respective piston lever; said controller comprising a link arm pivotally coupled at opposite ends thereof to proximal ends of piston levers of respective pistons of diametrically opposed cylinders whereby the excursion of one piston on a compression stroke is assisted by excursion of a diametrically opposed piston on a combustion stroke.

2. The rotary engine as claimed in claim 1 wherein each said piston lever comprises a substantially straight member.

3. The rotary engine as claimed in claim 1 wherein a pivotal axis of a pivotal coupling between a respective end of each link arm and a proximal end of a respective piston lever is displaced to one side of line intersecting respective said fulcrum points and a pivotal axis of a pivotal coupling between a distal end of each said piston lever and a respective piston assembly.

4. The rotary engine as claimed in claim 3 wherein each said piston lever is L-shaped.

5. The rotary engine as claimed in claim 3 wherein each said piston assembly is engaged, either directly or via a connecting rod, to a distal end of a respective piston lever, respective proximal ends of said piston levers being manipulated to control movement of a respective piston relative to a respective cylinder.

6. The rotary engine as claimed in claim 3 wherein said engine is a two-stroke engine.

7. The rotary engine as claimed in claim 1 wherein said engine is a two-stroke engine.

8. The rotary engine as claimed in claim 1 wherein said piston controller includes a cam member having one or more lobes on a circumferential surface thereof.

9. The rotary engine as claimed in claim 8 wherein said cam member engages respective proximal ends of said piston levers via a rotatable roller member.

10. The rotary engine as claimed in claim 8 wherein said cam member is rotationally independent of said rotatable member.

11. The rotary engine as claimed in claim 8 wherein said cam member is rotatable in an opposite direction to said rotatable member.

12. The rotary engine as claimed in claim 8 wherein said cam member is utilized to control piston dwell at either end of respective piston strokes.

13. The rotary engine as claimed in claim 8 wherein an energy stroke delivered to the rotatable member is longer than a combustion stroke of a piston.

14. The rotary engine as claimed in claim 8 wherein substantially all force exerted in relative movement between said cylinders and respective pistons is along respective longitudinal axes of said cylinders thereby reducing the effect of cylinder bore side thrust.

15. The rotary engine as claimed in claim 8 wherein said engine is a four-stroke engine.

16. The rotary engine as claimed in claim 1 wherein an energy stroke delivered to the rotatable member is longer than a combustion stroke of a piston.

17. The rotary engine as claimed in claim 1 wherein a compression stroke assists in supplying rotational energy to the rotatable member.

18. The rotary engine as claimed in claim 1 wherein a mass is associated with each piston lever, centrifugal force acting on said mass to aid excursion of said pistons within respective cylinders.

19. The rotary engine as claimed in claim 1 wherein substantially all force exerted in relative movement between said cylinders and respective pistons is along respective longitudinal axes of said cylinders thereby reducing the effect of cylinder bore side thrust.

20. The rotary engine as claimed in claim 1 wherein force generated at the cylinders is delivered directly to an output shaft via said rotatable member.

* * * * *